US008790044B2

(12) United States Patent
Locotos

(10) Patent No.: US 8,790,044 B2
(45) Date of Patent: Jul. 29, 2014

(54) TENSIONABLE TUBULAR RESIN ANCHORED TUBULAR BOLT AND METHOD

(75) Inventor: Frank M. Locotos, Bridgeville, PA (US)

(73) Assignee: F. M. Locotos Co., Inc., Pittsburgh, PA (US)

( * ) Notice: Subject to any disclaimer, the term of this patent is extended or adjusted under 35 U.S.C. 154(b) by 103 days.

(21) Appl. No.: 12/803,598

(22) Filed: Jun. 30, 2010

(65) Prior Publication Data

US 2011/0033246 A1 Feb. 10, 2011

Related U.S. Application Data

(60) Provisional application No. 61/273,542, filed on Aug. 5, 2009.

(51) Int. Cl.
*E21D 20/00* (2006.01)
*E21D 21/00* (2006.01)

(52) U.S. Cl.
CPC ..... *E21D 21/0026* (2013.01); *E21D 20/00* (2013.01)
USPC ..... 405/259.1; 405/259.6

(58) Field of Classification Search
USPC ..... 405/259.1, 259.3, 259.6, 302.1, 259.5; 411/82, 82.3
See application file for complete search history.

(56) References Cited

U.S. PATENT DOCUMENTS

| | | | | |
|---|---|---|---|---|
| 4,655,643 | A | 4/1987 | Lane et al. | |
| 4,765,778 | A | 8/1988 | Valentine | |
| 5,525,013 | A * | 6/1996 | Seegmiller et al. | 405/259.3 |
| 6,612,783 | B2 * | 9/2003 | Stankus et al. | 405/259.5 |
| 7,114,418 | B1 * | 10/2006 | Allen | 81/439 |
| 2004/0161316 | A1 | 8/2004 | Locotos et al. | |
| 2007/0297862 | A1 * | 12/2007 | Giraldo et al. | 405/259.6 |

* cited by examiner

*Primary Examiner* — Frederick L Lagman
*Assistant Examiner* — Patrick Lambe
(74) *Attorney, Agent, or Firm* — Ansel M. Schwartz

(57) ABSTRACT

A bolt includes a tube, at least a portion of which is hollow, having a top and the bottom and at least one dimple. The bolt includes an insert fixed to the interior of the tube in proximity to the dimple with the dimple disposed between the insert and bottom of the tube. A method for a bolt includes the steps of inserting a resin cartridge into a hole.

13 Claims, 6 Drawing Sheets

TENSIONABLE TUBULAR RESIN ANCHORED TUBULAR BOLT AND METHOD

CROSS-REFERENCE TO RELATED APPLICATIONS

This is a nonprovisional of U.S. provisional application Ser. No. 61/273,542 filed Aug. 5, 2009.

FIELD OF THE INVENTION

The present invention is related to a mine rock or roof bolts. (As used herein, references to the "present invention" or "invention" relate to exemplary embodiments and not necessarily to every embodiment encompassed by the appended claims.) More specifically, the present invention is a resin-anchored tubular bolt tensionable preferably without any threading that is tensioned by inserting an installation rod inside the tubular bolt, the top of which presses against some portion of the inside of the bolt above the head-end so as to mix the resin by turning the bolt and after mixing, to hold tightly to the roof of the mine or tunnel until the resin hardens; thus, leaving the bolt under tension.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Mine roof bolts (under tension) have traditionally been solid round steel bars (smooth or rebar type) that are threaded to accommodate an expansion anchor or a delay mechanism nut with resin anchor. The tension tubular bolt eliminates the need for threads on the bolts which can cause problems such as: Bad threads; Poor torque (tension); Spinners on anchors; Spring-back; Threads sticking out of nuts in low seams. Various relevant patents are described as follows.

(I) Tadolini—U.S. Pat. No. 5,127,769 (written up in the "10$^{th}$ International Conference on Ground Control in Mining"—Title of Paper: Thrust Bolting—A New Innovation in Coal Mine Roof Support)

This teaching featured using a solid bar or bolt—anchored in resin—and pushed against the head of the bolt and plate; thus, the roof rock interface with the plate.

(II) Locotos—U.S. Pat. No. 5,387,060 Tubular Bolt

This tubular bolt is resin anchored, but does not feature a method to tension it.

(III) Mechanical Roof Bolts

Feature a solid bar, threaded to accept an expansion anchor (such as Frazer & Jones Co. F-2B).

This Bolt must be turned to expand the anchor and grab the hole. A certain small number of these bolts fail on installation due to a number of reasons, most of which are related to the external threads of the bolt or internal threads of the expansion anchor.

(IV) Tension Rebar Bolts

These bolts feature a threaded resin anchored solid rebar bolt. The threaded portion is on the bottom end of the bolt (resin anchor at top). A delay type nut is placed on the threaded end permitting the bolt to be spun through the resin to mix, and then held until resin hardens. After this, the delay nut is turned until the delay mechanism is overcome (i.e.: shear pin) and the bolt is tensioned with threads of the bolt emerging from the nut. These threads emerging from the nut can be a nuisance in low seams. A small portion of these bolts show extreme amounts of threads showing—indicating a possible incorrect installation.

SUMMARY OF THE INVENTION

The present invention pertains to a bolt. The bolt comprises a tube, at least a portion of which is hollow, having a top and the bottom and at least one dimple. The bolt comprises an insert fixed to the interior of the tube in proximity to the dimple with the dimple disposed between the insert and bottom of the tube.

The present invention pertains to a method for a bolt. The method comprises the steps of inserting a resin cartridge into a hole. There is the step of inserting a bolt into the hole. There is the step of placing a top end of a drive tool into a hollow tube of the bolt until the top end of the tool contacts an insert in the tube in proximity to at least one dimple in the tube, with the dimple disposed between the insert and the bottom of the tube. There is the step of moving the tool up so the top end of the tool pushes the insert upwards, which pushes the tube upwards, causing the resin cartridge to break. There is the step of rotating the top end of the tool against the dimple, which causes the tube to rotate and mix the resin. There is the step of holding the drive tool against the insert until the resin hardens and a resultant tension remains on the bolt.

The present invention pertains to a method for making an installation tool for a tubular mine roof bolt. The method comprises the steps of cutting an elongate element to length. There is the step of forming opposing flat sides onto a top of the elongated element so the top end can fit into the bolt and turn the bolt.

The present invention pertains to an installation tool that fits on a mine roof bolting machine for turning a tubular mine roof bolt having an insert. The tool comprises a first elongate portion that has a top with opposing flat sides that fits inside of the bolt and catches on the tube bolt's interior surface to rotate the bolt when the first elongate portion is rotated. The tool comprises a second portion from which the first elongate portion extends, the second portion configured to engage with the bolting machine.

The present invention pertains to a method for a bolt. The method comprises the steps of inserting a resin cartridge into a hole. There is the step of inserting a bolt into the hole. There is the step of placing a top end of a installation tool into a hollow tube of the bolt. There is the step of moving the tool up, which pushes the tube upwards, causing the resin cartridge to break. There is the step of rotating the top end of the tool, which causes the tube to rotate and mix the resin. There is the step of holding the top end of the installation tool inside the tube until the resin hardens and a resultant tension remains on the bolt.

BRIEF DESCRIPTION OF THE SEVERAL VIEWS OF THE DRAWING

In the accompanying drawings, the preferred embodiment of the invention and preferred methods of practicing the invention are illustrated in which.

DESCRIPTION OF THE INVENTION

Figure 1:
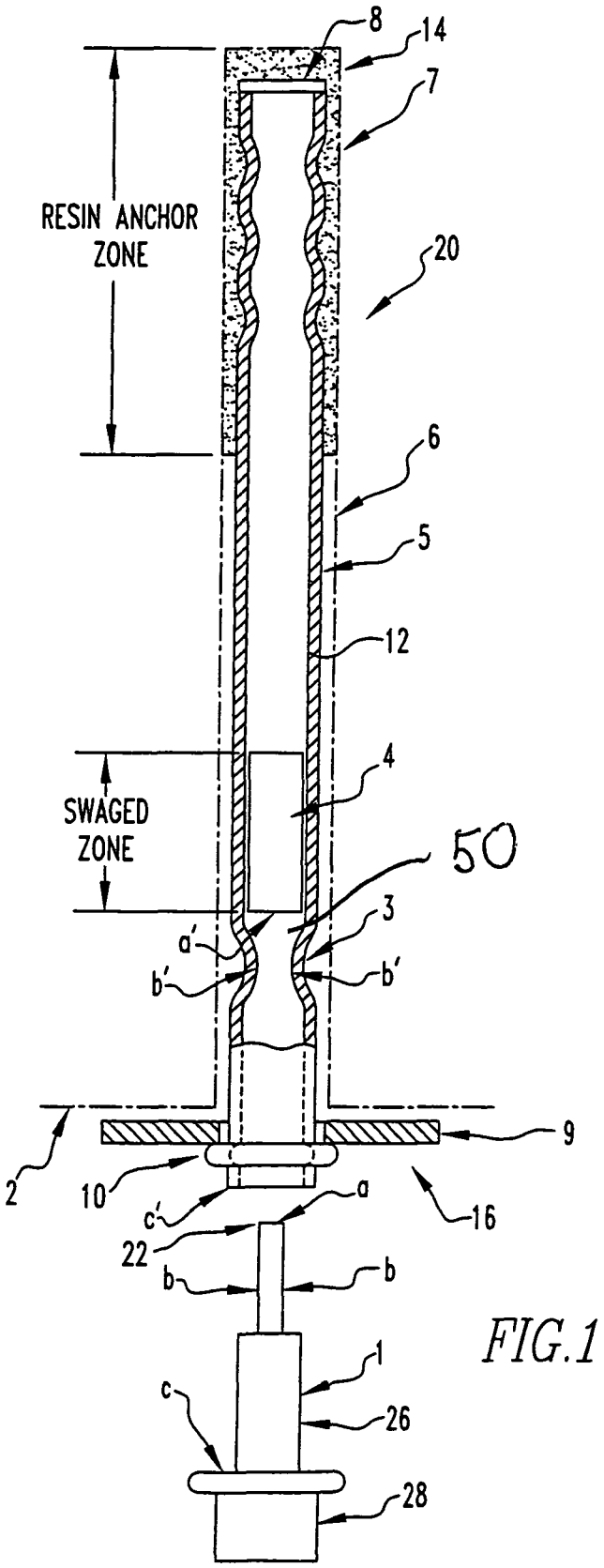
FIG. 1 is a representation of a mine roof bolt and installation tool of the present invention.

Referring now to the drawings wherein like reference numerals refer to similar or identical parts throughout the several views, and more specifically to FIG. 1 thereof, there is shown a bolt 5. The bolt 5 comprises a tube 12, at least a portion of which is hollow, having a top 14 and a bottom 16 and at least one dimple 3. The bolt 5 comprises an insert 4 fixed to the interior of the tube 12 in proximity to the dimple 3 with the dimple 3 disposed between the insert 4 and the bottom 16 of the tube 12.

Preferably, the tube 12 has no threading between the dimple 3 and the bottom 16 of the tube 12 and the tube's outside surface between the dimple 3 and the bottom 16 of the tube 12 is smooth. The insert 4 may be solid, although it could have a hole or holes through it if desired. The insert 4 may be swaged to the tube 12. The insert 4 may be metal, wood or plastic. The bottom 16 may have a formed head end 10. The bolt 5 may include an end cap 8 disposed in proximity to the top 14 of the tube 12. The bolt 5 may include a bearing plate 9 disposed about the tube 12 in proximity to the tube's bottom 16 and the formed head end 10.

The present invention pertains to a method for a bolt 5. The method comprises the steps of inserting a resin cartridge 18 into a hole 20. There is the step of inserting a bolt 5 into the hole 20. There is the step of placing a top end 22 of a installation tool 1 into a hollow tube 12 of the bolt 5 until the top end 22 of the tool contacts an insert 4 in the tube 12 in proximity to at least one dimple 3 in the tube 12, with the dimple 3 disposed between the insert 4 and the bottom 16 of the tube 12. There is the step of moving the tool up so the top end 22 of the tool pushes the insert 4 upwards, which pushes the tube 12 upwards, causing the resin cartridge 18 to break. There is the step of rotating the top end 22 of the tool against the dimple 3, which causes the tube 12 to rotate for a certain time to mix the resin and then stop. Then there is the step of holding the installation tool 1 against the insert 4 until the resin hardens and a resultant tension remains on the bolt 5.

The rotating step preferably includes the step of rotating the top end 22 of the tool 1 against the dimple 3, which causes the tube 12 to rotate without using threading of any type on the bolt 5 or on any part on the bolt 5.

The present invention pertains to a method for a bolt 5. The method comprises the steps of inserting a resin cartridge 18 into a hole 20, for instance in a mine roof. There is the step of inserting the bolt 5 into the hole 20. There is the step of placing a top end 22 of an installation tool 1 into a hollow tube 12 of the bolt 5. There is the step of moving the tool 1 up, which pushes the tube 12 upwards, causing the resin cartridge 18 to break. There is the step of rotating the top end 22 of the tool 1, which causes the tube 12 to rotate and mix the resin. There is the step of holding the top end 22 of the installation tool 1 inside the tube 12 until the resin hardens and a resultant tension remains on the bolt 5.

The present invention pertains to a method for making an installation tool 1 for a tubular mine roof bolt 5. The method comprises the steps of cutting an elongate element 42 to a desired length. There is the step of forming opposing flat sides 24 onto a top end 22 of the elongated element 42 so the top end 22 can fit into the bolt 5 and turn the bolt 5.

The present invention pertains to an installation tool 1 that fits on a mine roof bolting machine (not shown) for turning a tubular mine roof bolt 5 having an insert 4. The tool comprises a first elongate portion 26 that has a top end 22 with opposing flat sides 24 that fits inside of the bolt 5 and aligns within the tube bolt's interior surface (dimple) to rotate the bolt 5 when the first elongate portion 26 is rotated. The tool comprises a second portion 28 from which the first elongate portion 26 extends, the second portion 28 configured to engage with the bolting machine.

The present invention pertains to a hollow or tubular rock bolt—resin 7 anchored and tensioned with an installation tool 1 pushed by a roof bolting machine against the inside of the tubular bolt 5.

The unique installation tool 1 not only presses against the inside of the bolt 5 (above the head end) against an internal portion (insert 4) of the tubular bolt 5, it also acts to spin the bolt 5 through the resin cartridge 18 by pressing against the inside of a swaged wall (dimple) below the above mentioned internal portion.

The ability to tension the present bolt 5 invention is unique in that it requires no threaded parts, or threading. This is accomplished because the pushing mechanism (installation tool 1) is beyond the bearing plate 9 and rock interface. The bolt 5 is thus shoved through the resin cartridge 18, spun to mix, and then held tightly to the rock or roof interface by the roof bolting machine until the resin 7 hardens. This technique leaves the bolt 5 under a tension load. It should be noted that if desired, threading can be used for other purposes on the bolt 5 other than tensioning.

In regard to FIG. 1:

| PART# | DESCRIPTION |
|---|---|
| 1 | Installation tool. |
| 2 | Mine roof or rock surface. |
| 3 | Swaged dimple (b') in tubular bolt to contact (b) portion of drive tool. |
| 4 | Metallic insert placed inside tubular bolt which is swaged inside to tubular bolt to act as stop and drive member in conjunction with installation tool 1. |
| 5 | Tubular bolt. |
| 6 | Inside surface of drilled hole in roof rock. |
| 7 | Mixed resin around anchor end of tubular bolt. |
| 8 | End cap on top of tubular bolt to prevent resin from coming inside bolt when resin is in liquid state. |
| 9 | Bearing plate. |
| 10 | Formed head end of tubular bolt. |
| 12 | Tube of bolt. |
| 14 | Top |
| 16 | Bottom |
| 20 | Drilled hole in mine roof 2. |
| 22 | Top end of installation tool 1. |
| 26 | First elongate portion of installation tool 1. |
| 28 | Second portion of installation tool 1. |
| b | Flat sides of installation tool 1 to contact inside of dimpled (b') portion of tubular bolt to turn it and mix the resin at top anchor end. |
| a | Top end (a) 22 of drive tool (1) that contacts bottom end of swaged insert at (a'). This enables the installation tool 1 to hold a certain uplifting pressure against the inside of the |

-continued

| PART# | DESCRIPTION |
|---|---|
| | tubular bolt while the resin is hardening and therefore, leaves a certain installed tension on the tubular bolt. |
| c | Surface (c) of installation tool 1 which does not contact bottom surface (c') of formed bolt head during mixing and holding of bolt against roof while resin is mixed and subsequently hardened to form the anchor. |

Figures 2A, 2B, 2C, 2D, 2E:
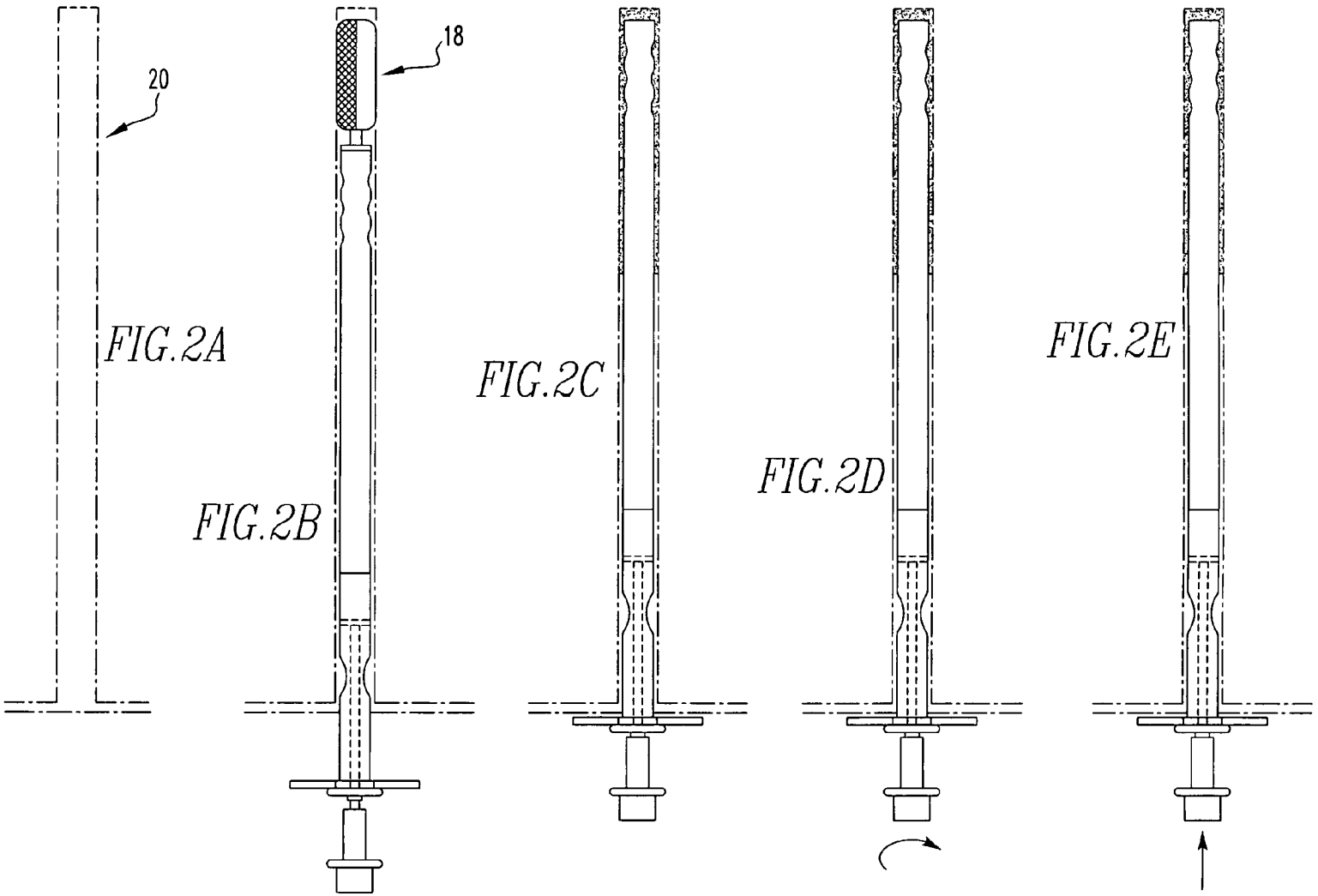
FIGS. 2*a*-2*e* show the steps of installation of the mine roof bolt of the present invention into a mine roof.

In regard to FIG. 2:

Sequence of Bolt Installation:

1. Hole is drilled into roof of mine (FIG. 2*a*).
2. Resin cartridge 18 and assembled bolt 5 with plate, are shoved to top of hole by installation tool 1 (FIG. 2*b*).
3. Bolt 5 is shoved through resin cartridge and plate is close and touching roof gently. (May require turning of bolt 5 to get through resin cartridge 18.) (FIG. 2*c*)
4. Bolt 5 is turned required amount of revolutions with installation tool 1 to mix resin 7 (FIG. 2*d*).
5. Mixing of resin 7 and turning of bolt 5 is stopped and installation tool 1 is forced via the bolting machine to place a vertical or axial load internally on the bolt 5 system while resin 7 is hardening or gelling, leaving a residual tension on the bolt 5. After resin 7 is hard, tool may be removed (FIG. 2*e*).

The insert 4 (FIG. 4) which is placed inside the tube 12 is a short length of Re-Inforcing Bar (1½" long) and swaged to the tubing just above the dimples (which are used to turn or spin the bolt 5 for mixing of resin 7). The 1½" long piece of rebar is ⅞" diameter. The most desired position for this insert 4, as shown in FIG. 3 is at the top of the bolt 5 directly above dimples.

The insert 4 would be set just inside the top end of the bolt 5 and then swaged to the tube 12 to hold it in place. It must be able to resist moving with enough strength that is applied by the installation tool 1. Testing proved that the bolt 5 could hold at least 25,000# force.

With the insert 4 swaged inside the top of the tubular bolt 5, this also acts as a cap to prevent liquid resin 7 and catalyst from flowing into the interior of the tubular bolt 5.

Figure 3:
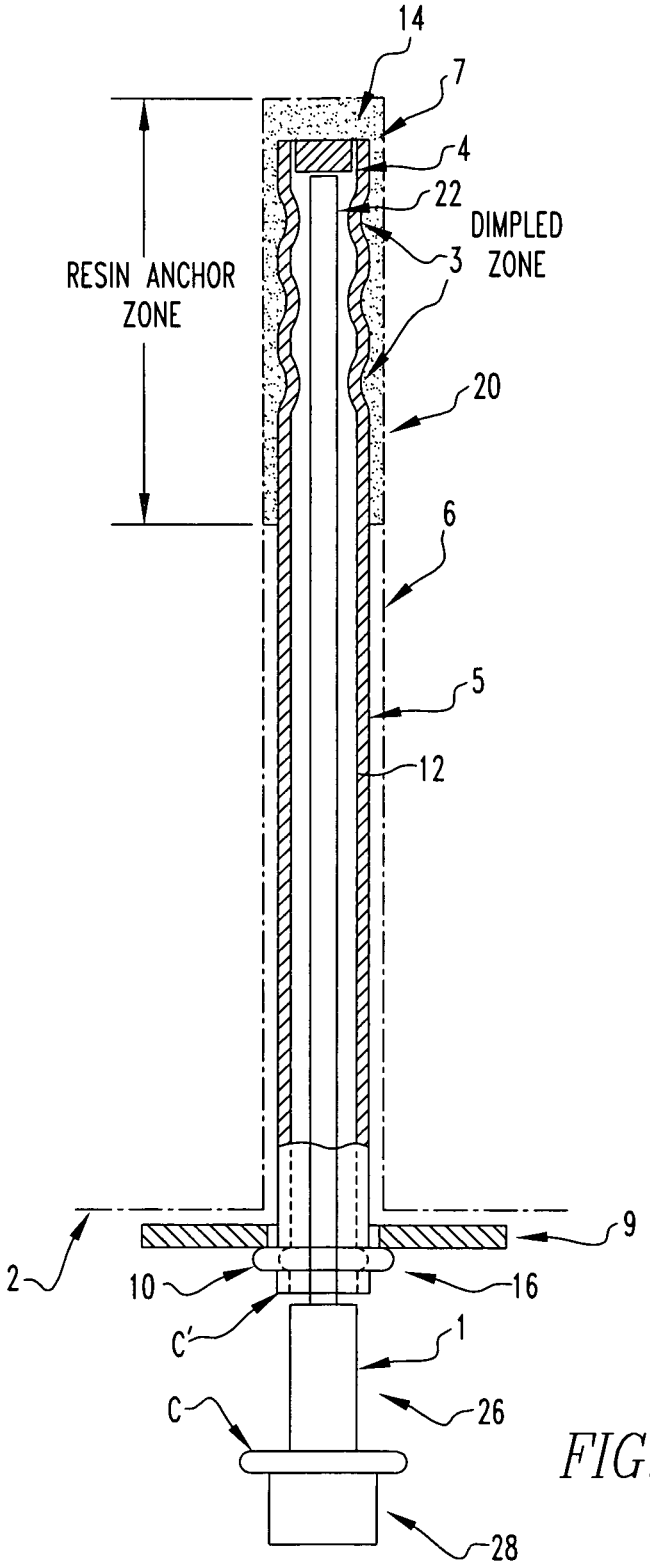
FIG. 3 shows another embodiment of the mine roof bolt and installation tool of the present invention.
Figure 4:
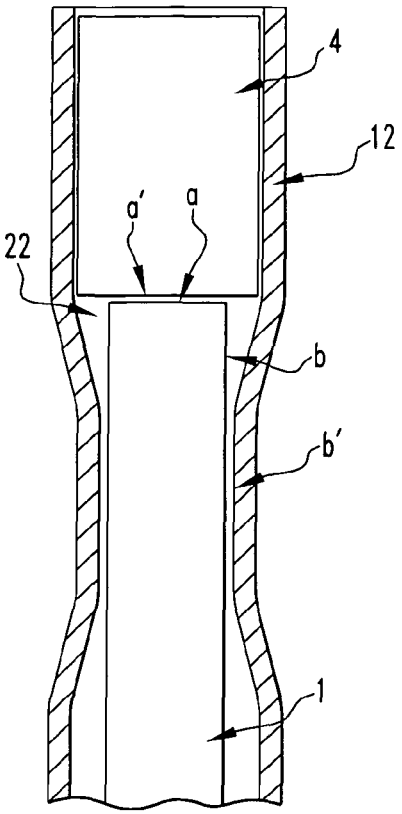
FIG. 4 shows a more detailed view of the tip of the installation tool engaging the insert of the mine roof bolt.

Function of the Installation Tool as it Presses Against the Insert and Turns the Bolt As can be viewed in FIG. 3, the installation tool 1 has a second portion 28, such as a head at the bottom end of the bolt 5. This end could be hex instead of square. The head end's purpose is to mate with the working end of the bolting machine. It is also used to turn the bolt 5 for mixing of the resin 7.

The lead end of the installation tool 1 is manufactured flat to pass through the interior of the dimpled zone. These flat surfaces bear against the corresponding flat surfaces of the interior of the dimples when turning the bolt 5 to mix the resin 7.

When the top of the installation tool 1 reaches the bottom end of the insert 4—the tool then begins to shove the bolt 5 into the hole and through the resin cartridge—see FIG. 2. NOTE: In FIG. 2, the insert 4 is nearer the bottom 16 or head-end of the bolt 5.

Once the installation tool 1 causes the bolt 5 to reach the top of the hole, (FIG. 2*c*, Step #3) and the bearing plate 9 is close to, and or snug to the roof or rock surface 2—the installation tool 1 is turned by the machine (FIG. 2*d*, Step #4) against the interior of the dimples to mix the resin 7.

After proper mixing time is accomplished, the turning is stopped and the bolting machine places a lifting force through the installation tool 1 and against the insert 4 (FIG. 2*e*, Step #5). This lifting force is dependent on how much is available from the machine. Some have upwards of 10,000 pounds. This force keeps the bolt 5 plate tight against the roof until the resin 7 hardens (could be 5(+) seconds depending upon resin 7 speed).

After the resin 7 hardens, the installation tool 1 is removed, and the bolt 5 is left in a tensioned state.

Figure 5A:
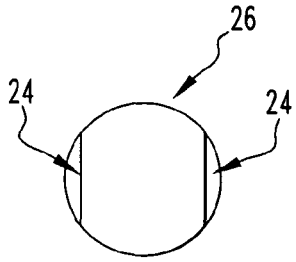
FIG. 5*a* is a top view of the installation tool.

FIG. 5*a* is a top view of the installation tool 1.

Figure 5B:
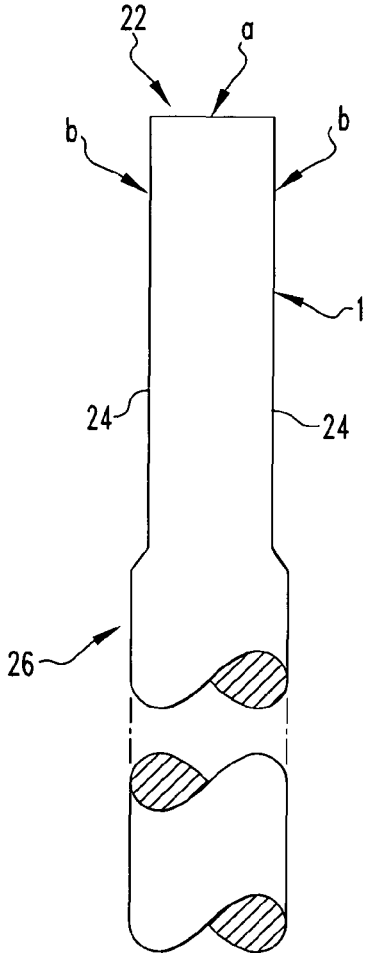
FIG. 5*b* is a side view of the top of the installation tool.

FIG. 5*b* is a side view of the top of the installation tool 1.

Figure 6:
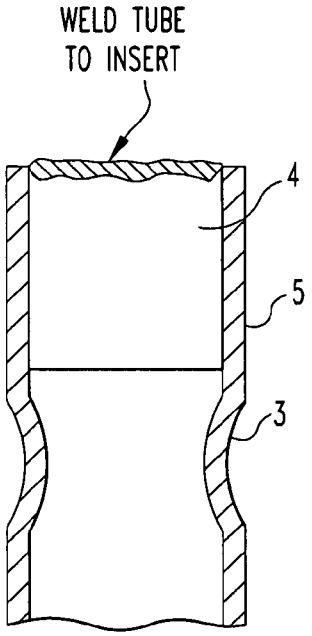
FIG. 6 is a detailed view of an alternative embodiment of the mine roof bolt.

FIG. 6 shows an alternative embodiment to fix the insert 4 in the tube 12 by welding. The insert 4 is positioned at the top of the tube 12, and then the top of the tube 12 is welded to the insert 4.

Figure 7:
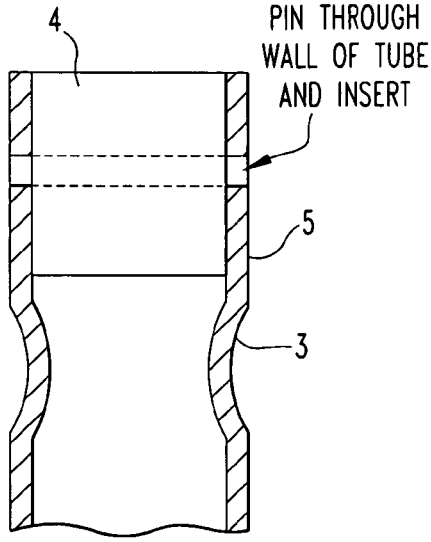
FIG. 7 is a detailed view of another embodiment of the mine roof bolt of the present invention.

FIG. 7 shows the insertion of a pin through the wall of the tube 12 and in the insert 4 to hold the insert 4 in place. The pin would be of a length so that the ends of the pin do not extend much beyond the outer circumference of the tube 12.

Figure 8:
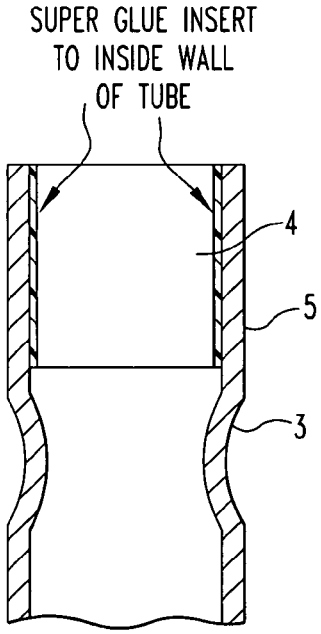
FIG. 8 is a detailed view of yet another embodiment of the mine roof bolt of the present invention.

FIG. 8 shows the insert 4 super glued to the inner tube wall.

Design of Installation Tool 1

The installation tool 1 is designed to go inside the tube 12 to perform three functions:

1) To press against the bottom side of the fixed insert 4 to raise the bolt 5 up the hole and through the resin 7.

2) To fit against the inside of the dimpled area which permits the installation tool 1 to turn the tubular bolt 5 to mix the resin 7.

3) To hold the tubular bolt 5 tight against the roof while the resin 7 hardens and the tubular bolt 5 is left in a tensioned state.

The installation tool 1 must also be adaptable to connection to the roof bolting machine.

Two types of tools have been made from:

1. Mine roof bolt
2. Hex drill steel

Figure 9:
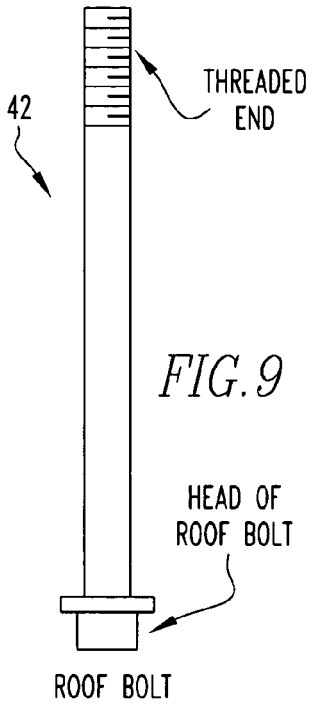
FIGS. 9 and 10 show the steps of making the installation tool from a roof bolt.
Figure 10:
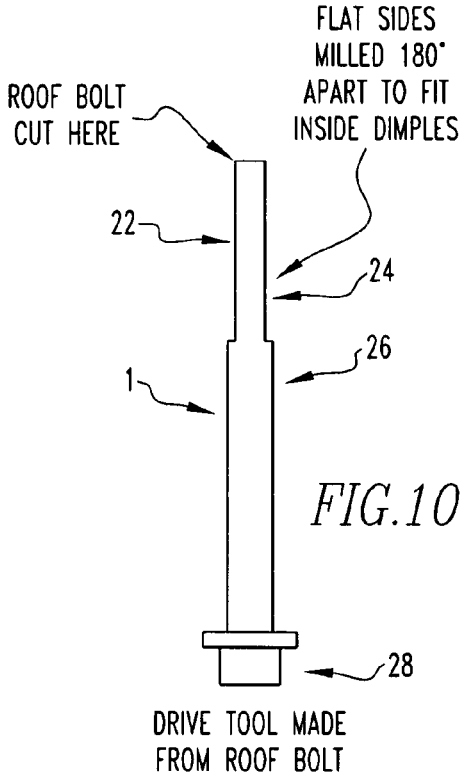

FIGS. 9 and 10 show the installation tool 1 made from a mine roof bolt 5. The head of the roof bolt fits in the roof bolting machine and the top of the finished installation tool 1 fits in the tubular bolt 5. The top the roof bolt, with threaded ends typically, is cut off and then flat sides are milled 180° apart at the top of the remaining portion of the roof bolt to fit inside the dimples of the tube 12. Alternatively, a headed bolt without threads can also be used to start with, to make the tool.

Figure 11:
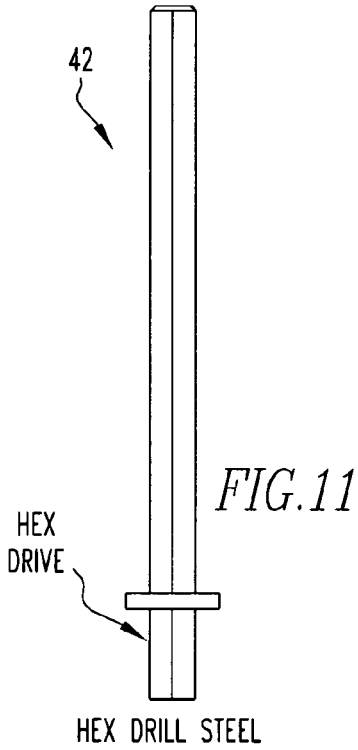
FIGS. 11 and 12 show the steps of making the installation tool from hex drill steel.
Figure 12:
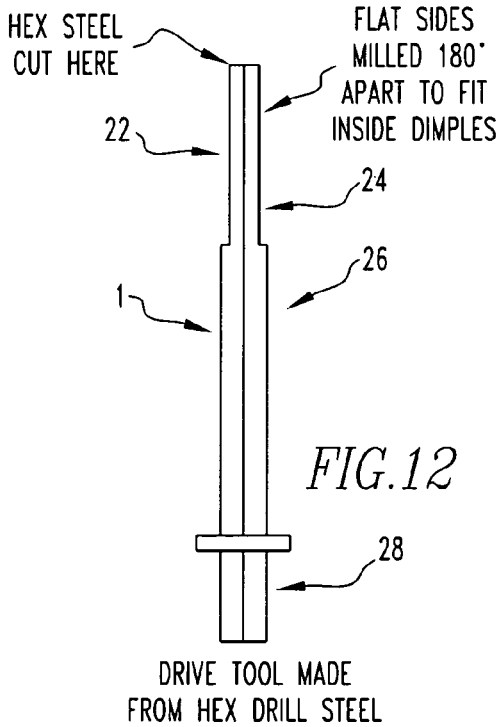

FIGS. 11 and 12 show the installation tool 1 made from hex drill steel. The top of the hex drill steel is cut off and then flat sides are milled 180° apart at the top of the remaining portion of the roof bolt to fit inside the dimples of the tube 12. The hex drive of the hex drive steel fits in the roof bolting machine and the top of the finished installation tool 1 fits in the tube 12 of bolt.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A bolt for a mine roof that is positioned in place in the mine roof with an installation tool of a mine roof bolting machine and resin of a resin capsule comprising:

a tube to be positioned in the mine roof, at least a portion of which is hollow, having a top and the bottom and at least one dimple formed from the tube so the tube with the dimple is one continuous piece, the dimple extends inward toward the tube's center, the hollow portion disposed between the dimple; and an insert permanently fixed and held in place to the interior of the tube in proximity to the dimple, the hollow portion of the tube extending above and below the insert, the installation tool of the mine roof bolting machine extending in and through the tube to press against and contact the insert for the installation tool to contact and rotate the tube by the tool pushing against the dimple's side as the tool rotates while the insert is fixed and held in place to the interior of the tube and the insert is disposed above the installation tool between the top and the installation tool with the installation tool pressing against the insert while the installation tool rotates against the dimple which rotates the tube, the insert acting as a stop and drive member in conjunction with the installation tool, the installation tool contacts the insert and enables an uplifting pressure against the insert while the resin is hardening and therefore leaves an installed tension on the bolt.

2. The bolt as described in claim 1 wherein the dimple is defined by a first indent in the tube and a second indent in the tube opposite too and in spaced relation with the first indent.

3. The bolt of claim 2 wherein the tube has a formed head.

4. The bolt as described in claim 3 wherein the tube has no threading between the dimple and the bottom of the tube and the tube's outside surface between the dimple and the bottom of the tube is smooth.

5. The bolt as described in claim 3 wherein the insert is spaced apart from the dimple.

6. The bolt as described in claim 3 wherein the insert fixed to the tube can hold at least 25,000 pounds of force.

7. The bolt as described in claim 6 wherein the insert is solid.

8. The bolt as described in claim 7 wherein the insert is swaged to the tube.

9. The bolt as described in claim 8 wherein the insert is metal.

10. The bolt as described in claim 9 wherein the bottom has a formed head end.

11. The bolt as described in claim 10 including an end cap disposed in proximity to the top of the tube.

12. The bolt as described in claim 11 including a bearing plate to contact the mine roof disposed about the tube in proximity to the tube's bottom and the formed head end.

13. The bolt as described in claim 12 wherein the dimple is disposed between the insert and bottom of the tube.

* * * * *